United States Patent [19]

Babu et al.

[11] 4,269,692

[45] May 26, 1981

[54] COAL REFINING

[75] Inventors: Suresh P. Babu, Darien; Richard A. Knight, Brookfield, both of Ill.

[73] Assignee: Institute of Gas Technology, Chicago, Ill.

[21] Appl. No.: 75,279

[22] Filed: Sep. 13, 1979

[51] Int. Cl.[3] ..... C10G 1/00

[52] U.S. Cl. ..... 208/8 LE; 208/10

[58] Field of Search ..... 208/8 LE, 8 R, 10

[56] References Cited

U.S. PATENT DOCUMENTS

| | | | |
|---|---|---|---|
| 1,881,927 | 10/1932 | Pott et al. | 208/8 LE |
| 2,123,380 | 7/1938 | Pott et al. | 208/8 LE |
| 2,147,753 | 2/1939 | Pott et al. | 208/8 LE |
| 2,202,901 | 6/1940 | Dreyfus | 208/8 LE |
| 2,476,999 | 7/1949 | Orchin | 208/8 LE |
| 3,558,468 | 1/1971 | Wise | 208/8LE |
| 4,134,821 | 1/1979 | Gorin | 208/8 LE |

*Primary Examiner*—Veronica O'Keefe
*Attorney, Agent, or Firm*—Thomas W. Speckman

[57] ABSTRACT

A process for fossil fuel refining by contacting ground solid fossil fuel for about ½ to about 3 hours with phenol at a temperature of about 600° to 690° F. and a corresponding saturation pressure of about 250 to 430 psig, the phenol being present in greater amounts by weight than the fossil fuel and dissolving refined product from the fossil fuel leaving a solid fuel residue. The phenol containing the refined product is removed from the fuel residue while heated, followed by cooling and separation of the refined product from the phenol which is recycled to the solvent extraction process. The process provides refined products low in mineral matter and sulfur following a low pressure solvent refining process which does not require a proton donor, acid catalyst or an external source of hydrogen.

12 Claims, No Drawings

COAL REFINING

BACKGROUND OF THE INVENTION

1. Field of the Invention

This invention relates generally to fossil fuel refining by solvent extraction to produce a high yield refined product which is low in mineral matter and sulfur. More specifically, this invention produces a low ash refined product by contacting, for up to about three hours, ground fossil fuel with phenol solvent at a temperature of about 600° to about 690° F. and a corresponding saturation pressure of about 220 to about 430 psig. The phenol solvent separates the refined product from the fossil fuel by dissolution, leaving behind a carbonaceous high mineral content residue.

2. Description of the Prior Art

Solvent extraction of bituminous coals has been recognized as desirable for many years. M. W. Kiebler, in his article, "Extraction of a Bituminous Coal: Influence of the Nature of Solvents," published in Gas Journal, Vol. 232, Dec. 4, 1940, pages 433–436, teaches treatment of Pittsburgh Seam coal with a large number of organic solvents, including phenol, which was reported to dissolve from about 21 to about 40 percent of the coal, based on recovery of organic material, following residence times of 72–120 hours at temperatures of 302° F. to 572° F. and phenol being present, on a weight basis, in an amount of about 20 times the coal. Depolymerization of bituminous coals with phenol at 212° F., wherein the reaction was catalyzed with boron trifluoride, which was found to be necessary to the depolymerization, was reported by L. A. Heredy and M. B. Neuworth, "Low Temperature Depolymerization of Bituminous Coal," Fuel, Vol. 41, pages 221–231, 1962. Solvent refining processes utilizing about 30 to 40 lbs. of hydrogen per ton of coal slurried in an anthracene oil solvent have been developed operating at about 1200 psi and 825° F., primarily to produce clean fuel with little or no sulfur. These processes are described in "Fossil Fuel to Fuel Conversion," New Energy Technologies, pages 162–170, and Kloepper, D. L., Rogers, T. F., Wright, T. F., and Bull, W. C., "Solvent Processing of Coal to Produce a De-Ashed Product," R & D Report No. 9, prepared for Office of Coal Research, Department of Interior, Washington, D. C. by Spencer Chemical Division, Gulf Oil Corporation, Dec., 1965. The requirement of hydrogen and its recycle together with the relatively high temperatures and pressures of this process requires costly and extensive process equipment. More recently, catalytic dealkylation of coal with phenol and p-toluene sulfonic acid was reported by R. H. Moore, E. C. Martin, J. L. Cox and D. C. Elliott, in "Coal Liquefaction by Aromatic Interchange with Phenol and Catalytic Hydrogenolysis" in Industrial and Laboratory Alkylations, pages 417, 437, American Chemical Society, Symposium Series, 1977, editors L. F. Albright and A. R. Goldsby. This work again emphasizes the apparent necessity of proton donor catalysts to achieve acid catalyzed depolymerization of coal with phenol. Supercritical extraction of coal with toluene has been reported by Whitehead, J. C., and Williams, D. F., "Solvent Extraction of Coals by Supercritical Gases," J. Inst. of Fuel, Vol. 48, page 182, 1975, and as described in U.S. Pat. No. 3,558,468, teaches extraction of coal with benzene or toluene at temperatures above the critical temperature of the solvent and pressures in the range of 1000 to 5000 psi.

SUMMARY OF THE INVENTION

This invention provides a process for fossil fuel refining providing refined products low in mineral matter and sulfur. The process of this invention provides a relatively low-pressure solvent refining process which does not require a proton donor, acid catalyst, or an external source of hydrogen. Since hydrogen is not required in the present process, the need for recycling gases at high pressures with associated filtering is not required and the refined products derived from the present process can be separated from fuel residue by liquid filtration at elevated temperatures up to reaction temperature. The refined product produced by the process of the present invention, being low in mineral matter and low in sulfur, can be used either as a low sulfur fuel or for subsequent hydrogenation to produce liquid hydrocarbons. The carbonaceous residual solids, noncaking and high in mineral matter, can be used for many purposes, such as gasification to produce a hydrogen-rich gas that may be used to upgrade the demineralized refined product.

The process of this invention involves contacting, for up to about three hours, ground solid fossil fuel with phenol solvent at a temperature of about 600° to about 690° F. and a corresponding saturation pressure of about 220 to 430 psig, the phenol being present in greater amounts than the fossil fuel on a weight basis. The phenol solvent dissolves the refined fuel leaving a solid residue of unconverted carbonaceous solids rich in mineral matter. The phenol solvent containing refined products may be readily withdrawn from the fuel residue while heated. The phenol solvent may then be further separated from unconverted solid fossil fuel by conventional filtration. The phenol solvent containing refined products may be cooled sufficiently to separate the refined products from phenol by precipitation, preferably to about ambient temperatures, and the refined products separated from phenol by filtration or sedimentation. The refined product can be further separated from the phenol solvent by simple distillation and the refined product stripped of absorbed phenol by steam stripping. The streams containing diluted phenol can be distilled to separate the water from the phenol which may then be recycled in the process.

We have found that by reacting bituminous coal with phenol for about 1 hour as much as 60 to 70 percent of the coal substance can be extracted in the form of a demineralized product. We have found that refined products from lower rank coals tend to be predominantly liquid products while higher rank coals resulted mainly in products which are solid at about ambient temperatures. The refined products are principally hydrocarbons which, for bituminous coals, have a boiling range in which about 50 percent boil between about 400° to 600° F. and molecular weights of about 400 to greater than 10,000.

DESCRIPTION OF THE PREFERRED EMBODIMENTS

Solid fossil fuels suitable for refining by the solvent extraction process of this invention include coals, particularly important being caking bituminous coals, subbituminous coals, and lignite. The terminology "fossil fuels" as used in this disclosure and claims means these materials and even though specific reference will be made to coal, it is meant to include fossil fuels. The process of this invention is particularly useful in producing low mineral matter content and low sulfur content refined product which could be subsequently converted to liquid hydrocarbons. The fossil fuel should be ground to a small particle size to assure good solid-liquid contact. Preferably, the coal is ground to −10 mesh. Ground coal is then contacted with phenol solvent in a pressure vessel maintained at reaction conditions. Contacting can be enhanced by agitation of the coal and solvent. The phenol-to-coal ratio should be greater than about 1, on a weight basis, to insure good contact for extraction and to provide good refined product transport. It is preferred to have a phenol-to-coal ratio of about 1 to 2, especially preferred is a ratio of about 1 to 1.5. The phenol may be utilized with up to about 20 percent, by weight, water present so that elaborate distillation to separate the phenol and water need not be performed.

The reactor containing phenol and ground solid fossil fuel is maintained at about 600° to 690° F., well below the plastic temperature of coal. The corresponding saturation pressure of about 220 to about 430 psig is maintained to retain the major portion of the phenol in the liquid state. The desired pressure may be obtained by pressurizing with an inert gas, such as nitrogen, to assist the phenol partial pressure. It is preferred for bituminous type coal to maintain temperatures of about 645° to about 650° F. and pressures of about 320 to about 325 psig. Pressures will be slightly higher (325 to 450 psig) when the feed material is a lower rank coal, due to higher levels of carbon dioxide from thermal decomposition at the same temperatures. The ground solid fossil fuel and phenol are agitated to promote contact under the reaction temperatures and pressure for under about 3 hours, preferably for about ½ hour to about 1½ hours.

At the end of the reaction time the phenol solvent containing refined product is removed from the fuel residue, preferably while at reaction temperatures to avoid precipitation of the extract and associated loss of desired product. The hot liquid phase is then cooled sufficiently for the refined coal product to precipitate. Ambient temperatures are suitable to obtain the product precipitate. The refined coal product may be separated from the phenol solvent by conventional filtration. The refined product may then be additionally stripped of residual phenol by any suitable method, for example, by steam stripping and/or by washing with aqueous NaOH solution, such as a 10% NaOH wash. The phenol-water mixture may then be distilled and the phenol recycled to the beginning of the process.

The process of this invention has been shown to extract about 60 to 70 percent of the hydrocarbon substance from a Pittsburgh seam coal, while the refined product contained about 30 percent of the original sulfur and less than about 10 percent of the original mineral matter. Thus, a refined product is obtained under mild reaction conditions wherein the reactants can be easily separated and recycled. The residual undissolved solid is non-caking and could be gasified to produce hydrogen for upgrading the refined product. The refined products of coal and other fossil fuels may be used as a feed stock for subsequent hydrogenation to produce liquid hydrocarbons.

The examples are set forth as exemplary of specific embodiments of this invention and the use of specific materials or conditions is not meant to limit the invention.

EXAMPLE I

Three samples of moderately caking Illinois #6 bituminous coal, each of the analysis typically shown in Table 1, were crushed and screened to −10 to +80 mesh. From 51.2 to 51.9 grams of the ground coal were placed in a wire basket in a two-liter autoclave vessel surrounded by an electrically heated fluidized sand bed. The coal, basket and reactor were heated to reaction temperature of 645°–650° F. and approximately 10 times the weight of coal of laboratory grade phenol was added with nitrogen pressure. The system temperature was brought back to 645°–650° F. and maintained at that temperature and 320–325 psig for 1 hour with magnetic stirring. The liquid phase was removed from the autoclave by depressurizing the contents into a cooled vessel. A quantity of deionized water was then added and removed after about 5 minutes. The autoclave was allowed to cool, and fuel residue removed from the wire basket and dried in a vacuum oven at 150° F. overnight and weighed. The phenol extract was separated by filtering off the precipitated refined product at about ambient temperature with washings with phenol and water. Phenol was extracted from the filtrate by mixing with 10% aqueous ammonia followed by filtration of precipitated refined product. The percent extraction or refined product, based upon the weight loss, was from 59.3 to 77.7, based upon three samples. The refined product had substantially the same carbon and hydrogen contents as the original coal, but only about 39 to 47 percent of the original sulfur content, and about 2 to 22 percent of the original ash content.

TABLE 1

| | | | Proximate: as received (% by weight) | | | | Ultimate: (Dry Ash-Free) (% by weight) | | | | |
|---|---|---|---|---|---|---|---|---|---|---|---|
| Type of Fossil Fuel | Source | Free-Swelling Index | Moisture | Volatile Matter | Fixed Carbon | Ash | Carbon | Hydrogen | Sulfur | Nitrogen | Oxygen |
| Bituminous | Illinois #6 II | 1½ | 2.9 | 31.9 | 57.0 | 8.2 | 80.25 | 5.08 | 2.69 | 1.71 | 10.27 |
| Bituminous | Illinois #6 III | 5 | 1.3 | 35.5 | 55.7 | 7.5 | 81.43 | 5.42 | 2.48 | 1.56 | 9.01 |
| Bituminous | Illinois #6 IV | 3 | 5.9 | 36.4 | 49.4 | 8.3 | 79.51 | 5.44 | 3.77 | 1.52 | 9.75 |
| Bituminous | Pittsburgh #8 | 8 | 1.8 | 34.8 | 52.7 | 10.7 | 82.12 | 5.58 | 3.29 | 1.42 | 7.59 |
| Sub-Bituminous | Montana | — | 21.9 | 31.5 | 39.3 | 7.3 | 72.17 | 4.80 | 0.70 | 1.30 | 21.03 |
| Lignite | Montana | — | 18.3 | 31.7 | 41.0 | 9.0 | 71.6 | 7.82 | 0.78 | 1.30 | 21.48 |

EXAMPLE II

Several samples of severely caking Pittsburgh #8 bituminous coal, each having the analysis typically shown in Table 1, were processed as set forth in Example I under the following conditions:

| Run No. | Solvent | Temp. °F. | Press psig | Time (Hrs.) | Percent Extraction (Refined Product) |
|---|---|---|---|---|---|
| 1 | 90% Phenol-Water | 660 | 325 | 3.0 | 69 |
| 2 | 90% Phenol-Water | 645 | 320 | 3.0 | 70 |
| 3 | 90% Phenol-Water | 605 | 245 | 3.0 | 69 |
| 4 | 90% Phenol-Water | 615 | 278 | 2.0 | 67.5 |
| 5 | 90% Phenol-Water | 615 | 265 | 1.0 | 63 |
| 6 | 93% Phenol-Water | 645 | 330 | 1.0 | 67.7 |
| 7 | 93% Phenol-Water | 640 | 290 | 0.5 | 66.7 |

The refined products had substantially the same carbon and hydrogen contents as the original coal, but only about 36 to 47 percent of the original sulfur content, and 2 to 20 weight percent of the original ash content. The refined product from Run 7 was typical and had the following analysis:

| Percent by Weight (Dry Ash-Free) | | | | |
|---|---|---|---|---|
| Total Carbon | Hydrogen | Sulfur | Nitrogen | Oxygen |
| 83.5 | 5.15 | 1.19 | 1.08 | 9.08 |

The ash content was about 0.63 dry weight percent.

EXAMPLE III

Sub-bituminous Montana coal having the analysis shown in Table 1 was processed as set forth in Example I with 93 percent phenol/water at 655° F., 365 psig for 1 hour resulting in about 44 percent extraction or refined product.

EXAMPLE IV

Montana lignite having the analysis shown in Table 1 was processed as set forth in Example 1 with 93 percent phenol/water at 675° F., 420 psig for 1 hour resulting in about 36 percent extraction or refined product.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for fossil fuel refining by solvent extraction comprising:

contacting for about ½ to about 3 hours ground solid fossil fuel with solvent consisting essentially of phenol at a temperature of about 600° to about 690° F. and a corresponding saturation pressure of about 250 to about 430 psig, said phenol being present in greater amounts than said fossil fuel on a weight basis, said phenol dissolving refined product from said fossil fuel leaving a solid fuel residue;

removing said phenol containing refined product from said fuel residue while heated;

cooling and separating refined product from phenol; and recycling phenol.

2. The process of claim 1 wherein said ground fossil fuel is a caking bituminous coal and said fuel residue is non-caking.

3. The process of claim 1 wherein said ground fossil fuel is bituminous coal, said contacting is carried out for about ½ to about 1½ hours at temperatures of about 645° to about 650° F. and a corresponding saturation pressure of about 320 to about 325 psig, yielding about 60 to about 70 percent, by weight, of low sulfur and low ash refined product.

4. The process of claim 1 wherein said phenol containing refined product is separated from residual solids by filtration at elevated temperatures.

5. The process of claim 4 wherein said refined product is separated from said phenol by cooling to about ambient temperature and filtering.

6. The process of claim 4 wherein additional refined product is separated from phenol by steam distillation.

7. The process of claim 4 wherein additional phenol is separated from refined product by aqueous NaOH wash.

8. The process of claim 1 wherein water is distilled from phenol prior to phenol recycle.

9. The process of claim 1 wherein said solvent consisting essentially of phenol contains up to 20 percent, by weight of water.

10. The process of claim 1 wherein said phenol is present in a phenol to coal ratio, on a weight basis, of about 1 to about 2.

11. The process of claim 1 wherein said refined product is characterized by a boiling range in which about 50 percent boils between about 400° and about 600° F. and molecular weights of about 400 to greater than 10,000.

12. The process of claim 9 wherein said solvent consisting essentially of phenol contains up to about 10 weight percent water.

* * * * *